US006110356A

United States Patent [19]

Hedrick et al.

[11] Patent Number: 6,110,356

[45] Date of Patent: Aug. 29, 2000

[54] SLURRY CIRCULATION PROCESS AND SYSTEM FOR FLUIDIZED PARTICLE CONTACTING

[75] Inventors: Brian W. Hedrick, Rolling Meadows; Mark Schnaith, Lake Zurich; Lawrence A Lacijan, Palatine, all of Ill.

[73] Assignee: UOP LLC, Des Plaines, Ill.

[21] Appl. No.: 09/073,482

[22] Filed: May 6, 1998

[51] Int. Cl.[7] ..... C10G 11/00

[52] U.S. Cl. ..... 208/113; 208/120.01; 585/648; 585/653

[58] Field of Search ..... 208/113, 120.01; 585/648, 653

[56] References Cited

U.S. PATENT DOCUMENTS

| | | | |
|---|---|---|---|
| 2,687,988 | 8/1954 | Stratford et al. | 196/52 |
| 2,859,175 | 11/1958 | Smith | 208/136 |
| 3,042,196 | 7/1962 | Payton et al. | 208/113 |
| 3,193,434 | 7/1965 | Sanford et al. | 208/120 |
| 3,338,821 | 8/1967 | Moyer et al. | 208/113 |
| 3,458,691 | 7/1969 | Boyd, Jr. | 235/151.12 |
| 3,751,359 | 8/1973 | Bunn, Jr. | 208/155 |
| 3,812,029 | 5/1974 | Snyder, Jr. | 208/113 |
| 3,849,294 | 11/1974 | Hansen | 208/162 |
| 4,003,822 | 1/1977 | Jo | 208/102 |
| 4,143,086 | 3/1979 | Carle et al. | 260/683 PD |
| 4,194,965 | 3/1980 | Billings et al. | 208/113 |
| 4,207,167 | 6/1980 | Bradshaw | 208/68 |
| 4,285,805 | 8/1981 | Stegelman | 208/113 |
| 4,345,991 | 8/1982 | Stegelman | 208/78 |
| 5,264,115 | 11/1993 | Mauleon et al. | 208/67 |
| 5,310,477 | 5/1994 | Lomas | 208/78 |
| 5,506,365 | 4/1996 | Mauleon et al. | 585/329 |

*Primary Examiner*—Walter D. Griffin
*Assistant Examiner*—Nadine Preisch
*Attorney, Agent, or Firm*—Thomas K. McBride; John G. Tolomei

[57] ABSTRACT

The invention improves a system and apparatus for the recovery of fine solid particles entering the slurry system of a fluidized catalytic contacting process by returning a portion of the recovered solids from the main separator directly back to the reactor stripper. The invention recovers fine particulate material from an FCC main column and returns the particulate material to an FCC stripper to reduce the amount of fine material that continues to recycle through the FCC reactor and product separator. By returning fine particulate material from the FCC product separation zone directly to a low velocity area of the stripping section, the invention breaks the reactor—main column recycle loop that concentrates the fines. Fines entering the reactor stripper will not be carried back into the cyclones for unwanted return to the main column. By the recycling of fines to the stripper via this invention, the fines concentration in the slurry system can decrease by up to 300%.

10 Claims, 2 Drawing Sheets

SLURRY CIRCULATION PROCESS AND SYSTEM FOR FLUIDIZED PARTICLE CONTACTING

FIELD OF THE INVENTION

This invention relates generally to separation processes and more specifically to processes for the separation of particulate material from the effluent of a vapor stream recovered from a fluidized particle contacting arrangement.

BACKGROUND OF THE INVENTION

A good example of a fluidized particle contacting process is the fluidized catalytic cracking of hydrocarbons. The fluidized catalytic cracking of hydrocarbons is the mainstay process for the production of gasoline and light hydrocarbon products from heavy hydrocarbon charge stocks such as vacuum gas oils or residual feeds. Large hydrocarbon molecules associated with the heavy hydrocarbon feed are cracked to break the large hydrocarbon chains or ring structures thereby producing lighter hydrocarbons. These lighter hydrocarbons are recovered as product and can be used directly or further processed to raise the octane barrel yield relative to the heavy hydrocarbon feed. The basic equipment or apparatus for the fluidized catalytic cracking of hydrocarbons has been in existence since the early 1940's and, along with its method of operation, is well known to those skilled in the art of hydrocarbon processing.

The cracked products from an FCC reaction section are first separated from the particulate material by disengagement in a reactor vessel or by any other primary separation device followed by passage of the vapor stream through at least one secondary separator to remove the majority of any entrained particulate material. The separated vapors are then delivered directly to product separation facilities associated with the FCC unit. These separation facilities include a primary separator, often referred to as a main column, and a compression section containing numerous separators and contactors for further separating overhead vapors from the main column. The compression section is commonly referred to as the gas concentration section. Invariably the vapors passing to the product separation facilities will contain a small quantity of the most fine particulate material that also enters the product separation facilities.

Routinely in the prior art, as shown by U.S. Pat. Nos. 3,849,294; 3,458,691; 4,003,822 and 3,042,196, the primary separator or the main column separates the remaining heavier fractions into product streams such as gasoline and other distillates, into other heavier streams for recovery and/or other processing such as light cycle oil and heavy cycle oil, and into a bottom stream that is ordinarily recycled to the reaction zone. Entrained fine particles collect in the heavy bottom stream. As shown by the above-cited references, a settler ordinarily concentrates the catalyst particles into a slurry that also passes back to the reaction zone. The return of the solids concentrated from the main column bottoms in a separator or other device tends to increase the concentration of solids in the circulating hydrocarbons that circulate in a recycle loop from the reactor through the main column bottom and back to the reactor. The solids eventually escape from the reactor recycle loop by passing in small quantities through the stripper and finally to the regenerator. The most fine particles tend to remain confined in the circulation loop on the reactor side of the process due to the tendency of the lighter particles to remain with the products carried overhead by the reactor cyclones. This type of circulation can result in solids equilibrating in the reactor—main column recycle loop of the process and causing a threefold increase in the solids concentration before the trapped fine particles exit the process via the regenerator and flue gas system. The three pass average for the circulation of fine catalyst particles through the slurry circuit before escaping the process aggravates erosion and plugging problems in the slurry circuit and often overloads any filtration systems that employed to concentrate the solids for recovery and recycle. Today's practice of closing the cyclone and other reactor systems for vapor containment the problems of excessive fine particle recycle in the slurry system by the increasing concentration of solids in downstream cycle separators.

Other prior art systems have been known that recover the fine catalyst particles in a different manner for return to the reaction side of the process. U.S. Pat. No. 2,859,175 shows a system wherein the solids are recovered from a main fractionator and passed back to the top of a dense bed that holds catalyst for passage to a reaction zone. The '175 system provides no way for the fine particles to escape from the dense bed that supplies the catalyst to the reaction zone without first passing the fines again through the fractionator. Some of the very early FCC U.S. Pat. No. 2,687,988 did not need to consider the recirculation of fines in any manner separate from the general recirculation of the catalyst.

BRIEF DESCRIPTION OF THE INVENTION

This invention is an improvement in a system and apparatus for the recovery of fine solid particles that enter the slurry system of a fluidized catalytic contacting process. Suitable fluidized contacting units generate a fluid stream containing a fine particulate material from which fluid components are recovered and fine particulate material is returned to the contacting system for eventual withdrawal from the process through a regeneration system that rejuvenates the solid particulate material. In a specific form, the invention recovers fine particulate material from an FCC main column and returns the particulate material to an FCC stripper to reduce the amount of fine material that continues to recycle through the FCC reactor and product separator. By returning fine particulate material from the FCC product separation zone directly to a low velocity area of the stripping section, the invention breaks the reactor—main column recycle loop that concentrates the fines. Fines entering the reactor stripper will not be carried back into the cyclones for unwanted return to the main column. The FCC stripper provides a particularly advantageous place for injection of the slurry or other recycle that contains the catalyst fines since it will tend to hold the fines in the bed and the low superficial gas velocity through the bed will make reentrainment or elutriation difficult. By the recycling of fines to the stripper via this invention, the fines concentration in the slurry system can decrease by up to 300%.

Reducing the recycling of fines back to the riser can minimize several negative effects. Contacting the hot, clean catalyst in the riser with the heavy oil that typically carries the recovered solids increase the production of light gases, often referred to as non-condensable or dry gas, and reacts the heavy oil into the coke that deposits on the catalyst. The elevated reaction potential of the hot regenerated catalyst raises the production of gas and coke from the heavy oil containing the particles. Whether the heavy oil comprises slurry oil, heavy cycle oil, light cycle oil, or naphtha, recycling the fines to the stripper exposes the heavy oil to cooler temperatures and less active catalyst. Therefore, greatly reduced reaction potential results in the benefits of producing less reaction coke and dry gas.

Recycling hydrocarbons with the fines directly to the stripper can result in the carryover of heavy hydrocarbons into the regenerator. Several methods are available to minimize such carryover of the effect of such carryover. One such method is the use of light cycle oil instead of heavy cycle oil or main column bottoms to carry the solids from any recovery system in the product separation system back to the stripper. The light cycle oil will tend to vaporize easier than the heavier materials and will, therefore, minimize the potential for hydrocarbon carryover into the regenerator with the resulting production of relatively less coke. A typical FCC slurry system will ordinarily contain filters or other methods to concentrate the solids for return to the reaction zone. Additional concentrators can minimize the needed hydrocarbon for injection of fines into the stripper. The particularly preferred concentrator would be a hydroclone for receiving the recycled fines in a hydrocarbon vehicle and further separating hydrocarbons to additionally concentrate the fines and minimize the carrier liquid. Any carryover of heavy hydrocarbons or production of additional coke will not impose any significant problems for systems that are designed to handle heavy residual feedstocks or other heavy hydrocarbon feedstreams since such processes ordinarily have systems for removing the excess heat evolved by the combustion of additional coke.

Accordingly, in one embodiment this invention is a process for the production and separation of a fluidized catalytic cracking product stream that contains fine catalyst particles. The process passes an FCC feedstock and regenerated catalyst particles to a reaction zone to convert the feedstock. The process separates catalyst particles from gaseous hydrocarbons and recovers an FCC product stream containing fine catalyst particles and passes the separated particles to a relatively dense bed. A fractionation zone that receives the product stream further separates the product stream into at least a relatively light hydrocarbon stream and a relatively heavy hydrocarbon stream. A particle recycle stream containing the fine catalyst particles and at least a portion of the relatively heavy hydrocarbon stream is recovered and injected into a relatively dense bed at an injection point. The process withdraws a coked catalyst stream comprising at least a portion of the relatively fine particles from the relatively dense bed at a location below the injection point and passes the coked catalyst stream to a regeneration zone. The regeneration zone combusts coke from the catalyst particles to generate flue gas that passes out of the regeneration zone and carries entrained fine catalyst particles therewith while supplying regenerated catalyst to the reaction zone.

Other objects, embodiments and details of this invention can be found in the following detailed description of the invention.

DETAILED DESCRIPTION OF THE PREFERRED EMBODIMENT

Figure 1:
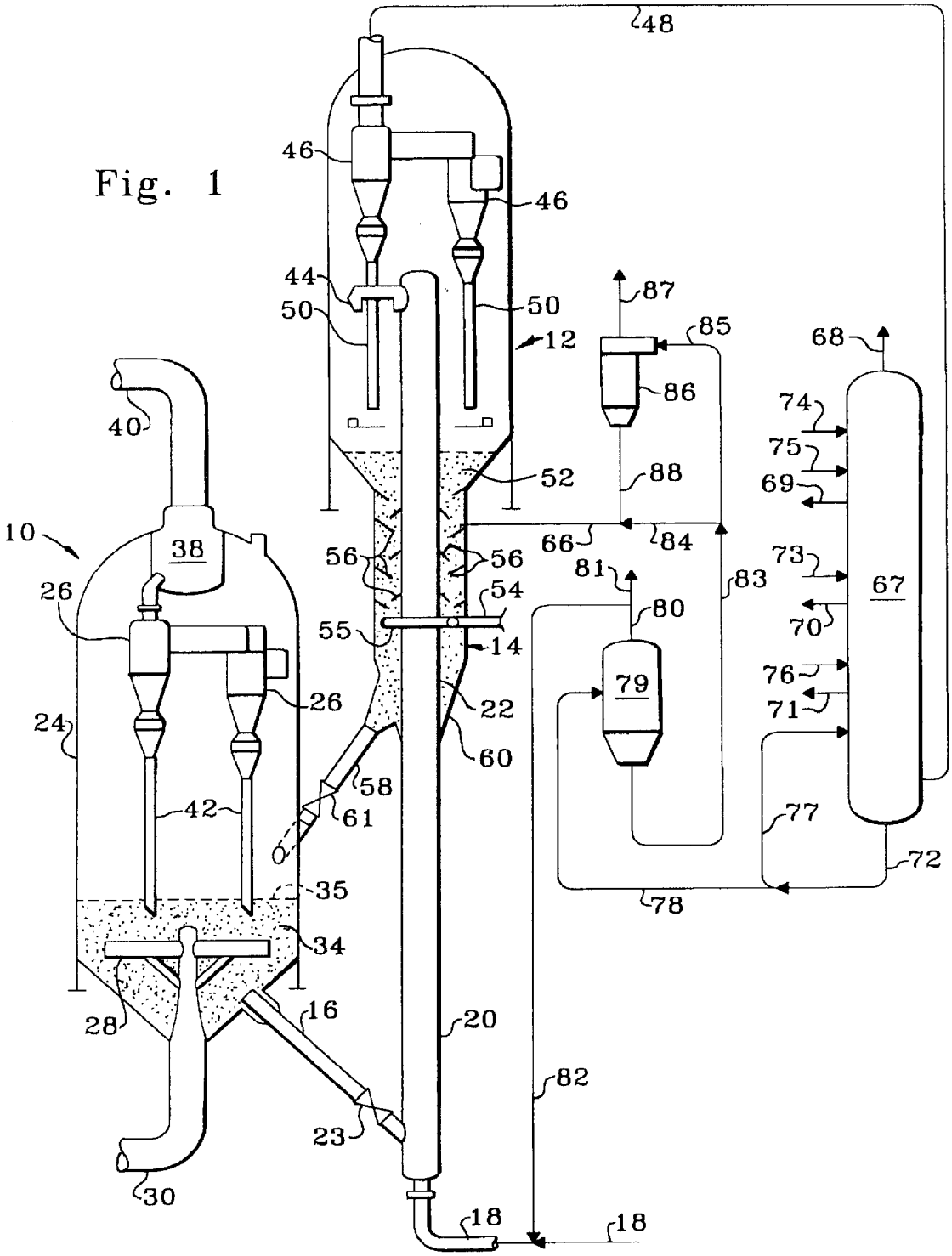
FIG. 1 is a schematic flow diagram of a primary separator, an FCC reaction zone, and an FCC regeneration zone.

The process and apparatus of this invention is described in the context of the drawings. Reference to the specific configuration shown in the drawings is not meant to limit the process of this invention to the particular details of the drawing disclosed in conjunction therewith. The drawings are schematic representations and omit many of the valves, instruments, pumps and other equipment associated with the arrangement of this invention when unnecessary for an understanding of the invention.

The FCC process will employ a wide range of commonly used catalysts which include high activity crystalline alumina silicate or zeolite containing catalysts. Zeolite catalysts are preferred because of their higher intrinsic activity and their higher resistance to the deactivating effects of high temperature exposure to steam and exposure to the metals contained in most feedstocks. Zeolites are usually dispersed in a porous inorganic carrier material such as silica, aluminum, or zirconium. These catalyst compositions may have a zeolite content of 30% or more. Particularly preferred zeolites include high silica to alumina compositions such as LZ-210 and ZSM-5 type materials. Another particularly useful type of FCC catalysts comprises silicon substituted aluminas. As disclosed in U.S. Pat. No. 5,080,778, the zeolite or silicon enhanced alumina catalysts compositions may include intercalated clays, also generally known as pillared clays.

Feeds that may be used in conjunction with this invention include conventional FCC feedstocks or higher boiling hydrocarbon feeds. The most common of the conventional feedstocks is a vacuum gas oil which is typically a hydrocarbon material having a boiling range of from 650–1025° F. and is prepared by vacuum fractionation of atmospheric residue. Such fractions are generally low in coke precursors and heavy metals which can deactivate the catalyst. This invention may also be used in the cracking of heavier or residual feedstocks and any description of this invention as useful for the FCC process is not meant to exclude its application to processes for treatment of non-conventional feeds. Heavy or residual charge stocks are those boiling above 930° F. which frequently have a high metals content and which usually cause a high degree of coke deposition on the catalyst when cracked. Both the metals and coke deactivate the catalyst by blocking active sites on the catalyst. Coke can be removed, to a desired degree, by regeneration and its deactivating effects overcome. Metals, however, accumulate on the catalyst and poison the catalyst by fusing within the catalyst and permanently blocking reaction sites. In addition, the metals promote undesirable cracking thereby interfering with the reaction process. Thus, the presence of metals usually influences the regenerator operation, catalyst selectivity, catalyst activity, and the fresh catalyst make-up required to maintain constant activity. The contaminant metals include nickel, iron and vanadium. In general, these metals affect selectivity in the direction of less gasoline and more coke. Various metal management or treatment procedures are known by those skilled in the art when processing such heavy or refractory feeds.

Looking then at FIG. 1, the FCC arrangement has a regeneration vessel 10, a reactor 12, located to the side and above the regenerator, and a stripping vessel 14 located directly below the reactor. A regenerated catalyst conduit 16 transfers catalyst from the regenerator through a control valve 23 and into a riser conduit 20 where it contacts hydrocarbon feed entering the riser through hydrocarbon feed conduit 18. Conduit 18 may also contain a fluidizing medium such as steam which is added with the feed. Expanding gases from the feed and fluidizing medium convey catalyst up the riser and into internal riser conduit 22. As the catalyst and feed pass up to the riser, the hydrocarbon feed cracks to lower boiling hydrocarbon products.

Riser 22 discharges the catalyst and hydrocarbon mixture through the opening of riser outlet 44 to effect an initial separation of catalyst and hydrocarbon vapors. Outside of outlet 44, a majority of the hydrocarbon vapors continue to move upwardly into the inlet of cyclone separators 46 which effects a near complete removal of catalyst from the hydrocarbon vapors, except for catalyst fines to which this invention is directed. Separated hydrocarbon vapors exit reactor 12 through an overhead conduit 48 while a dip leg conduit 50 returns separated catalyst to a lower portion of the reactor vessel. Catalyst from riser outlets 44 and dip leg conduit 50 collects in a lower portion of the reactor forming a bed of catalyst 52.

Bed 52 supplies catalyst to stripping vessel 14. A line 66 injects a hydrocarbon stream containing a high concentration of fine catalyst particles into an upper portion of bed 52. Steam entering stripping vessel 14 through a conduit 54 is distributed by a ring 55 and rises countercurrent to a downward flow of catalyst through the stripping vessel thereby removing sorbed hydrocarbons from the catalyst which are ultimately recovered with the steam by cyclone separators 46. The rising stripping gas produces a superficial gas velocity through the stripping zone that is less than 1 ft/sec and more typically less than 0.5 ft/sec. The low superficial velocity maintains a relatively dense bed with an overall catalyst density in a range of from 20 to 50 lb/ft$^3$ and more often in the range of 35 to 45 lb/ft$^3$. In order to facilitate hydrocarbon removal, a series of downwardly sloping baffles 56 are provided in the stripping vessel 14. A spent catalyst conduit 58 removes catalyst including a high proportion of the catalyst fines injected from conduit 66 from a lower conical section 60 of stripping vessel 14. A control valve 61 regulates the flow of catalyst from conduit 58 into a dense bed 35 of regenerator 10.

Regeneration gas, such as compressed air, enters regenerator 10 through a conduit 30. An air distributor 28 disperses air over the cross-section of regenerator 10 where it contacts spent catalyst in bed 34 having an upper bed level 35. Coke is removed from the catalyst by combustion with oxygen entering from distributor 28. Combustion by-products and unreacted air components rise upwardly along with entrained catalyst through the regenerator into the inlets of cyclones 26. A gas relatively free of large catalyst particles, but containing a majority of the catalyst fines, collects in an internal chamber 38 which communicates with a gas conduit 40 for removing spent regeneration gas from the regenerator and the catalyst fines of this invention from the process. Separated catalyst from the cyclones drops from the separators through dip leg conduits 42 and returns to bed 34.

From the vapor outlet of the reactor, conduit 48 carries the cracked vapors, steam and fine catalyst particles to a primary separation zone comprising a main column 67. Fine particles carried over from the reaction zone will usually have a size in a range of from 0.2 to 40 microns. The concentration of these particles carried over by the gas stream will usually comprise from 0.5 to less 0.08 wt % of the gas stream. Most main columns will fractionate the cracked vapors into at least four streams comprising a gas stream, a naphtha stream, a cycle oil stream and a heavy oil or residual stream. The Figure shows main column 67 fractionating the vapors into five streams and withdrawing an overhead stream 68 containing a light naphtha fraction for further recovery as gasoline, a heavier heavy naphtha stream 69 for providing distillate and additional heavy gasoline, a next higher boiling cut in a line 70 comprising a light cycle oil, a yet higher boiling fraction 71 comprising heavy cycle oil and a heavy hydrocarbon bottoms steam in line 72.

As known to those skilled in the art, a gasoline fraction can be subdivided by the main column as shown or by other means into heavy and light gasoline cuts. The light gasoline fraction is typically withdrawn with an initial boiling point in the $C_5$ range and an end point in a range of 300–400° F. and, preferably, is withdrawn with an end point of about 380° F. The cut point for this fraction is preferably selected to retain olefins which would otherwise be lost by additional cracking to lighter components and saturation. The cut point may be controlled to optimize the octane barrels for the gasoline pool by the recycle of heavy gasoline. The heavy gasoline cut ordinarily comprises the next heavier fraction boiling above the light gasoline fraction. The naphtha stream of this invention generally corresponds to the heavy gasoline cut and will typically have a lower cut point in a range of from 250 to 380° F. and an upper cut point in a range of from 380° F. to 480° F. At the operating conditions of the main column, this upper cut point will be at about the boiling point of $C_9$ aromatics, in particular 1,2,4-trimethylbenzene. A lower cut point temperature for the naphtha fraction, down to about 320° F., but preferably above 360° F., will bring in additional $C_9$ aromatics. In its most basic form, the upper end of the naphtha cut is selected to retain $C_{12}$ aromatics. Therefore, naphtha will usually have an end point of about 400–430° F. and more preferably about 420° F.

The entire light gasoline fraction, and where desired heavier parts of the naphtha stream, may enter a gas concentration section that uses a primary absorber and, in most cases, a secondary absorber to separate lighter components from the gasoline stream using fractions from the main column or the gas concentration section as adsorption streams. A portion of the overhead stream 68 ordinarily returns to column 67 as reflux via a line 74. A portion of the heavy naphtha may also be refluxed to the column 67 via a line 75. Unless otherwise noted in this specification, the term "portion"—when describing a process stream—refers to either an aliquot portion of the stream or a dissimilar fraction of the stream having a different composition than the total stream from which it was derived.

The light cycle oil fraction recovered via conduit 70 will comprise the next hydrocarbon fraction having a boiling point above the heavy gasoline stream and will usually have an end boiling point in a range of about 450–700° F. Any net product stream of light cycle oil typically undergoes steam stripping (not shown) to meet flash point requirements before it is sent to product storage. A circulating light cycle oil fraction can also serve as a reboiling medium for one or more columns in the gas concentration section. After cooling any remainder of the light cycle oil stream is ordinarily refluxed to the column 67 via line 73.

The heavy cycle oil will have a boiling point in a range of about 500–750° F. After withdrawing a net portion of the heavy cycle oil for recycle to the riser or as a net product from fraction 71, the remainder is typically heat exchanged for heat recovery and recycled to the main fractionator 67 via a line 76. The heavy cycle oil stream will also normally provide a 475 to 650° F. hot stream for reboiling one or more columns in the gas concentration section. The recovered energy is also utilized to provide the final preheat for the feed to the riser and for the generation of high pressure steam. At other times, a net amount of this stream is withdrawn and recycled with the fresh feed to the reactor riser.

A portion of the heavy hydrocarbon stream from line 72 passes, after heating, to the main fractionator 67 via line 77. The remaining portion of the heavy hydrocarbon stream is withdrawn by line 78 for other processing such as the removal of fine catalyst particles. Preferably, the remaining portion of the heavy hydrocarbon stream carried by line 78 will enter a means for concentrating solids and recovering clarified oil that is relatively free of particulate material. By "relatively free of particulate material," it means that the concentration of the particulate material will ordinarily be at a level of less than 0.05 wt % of the clarified oil. FIG. 1 shows a concentrator in the form of a slurry settler 79 that receives the particle containing stream from line 78.

The clarified stream from settler 79 exits overhead via line 80. Line 80 will normally comprise heavy bottoms from the main column 67 which may be removed as a product stream via line 81 or, more typically, be recycled at least in part via line 82 to the feed stream via line 18.

A recycle stream containing a relatively high concentration of the solids—typically in a range of from 0.5 to 10 wt %—leaves the bottom of settler 79 via a line 83 and may be recycled directly to stripping zone 14 via a line 84. A preferred form of this invention, a line 85 carries at least a portion of the concentrated solid stream from line 83 into an additional concentrator that further reduces the amount of hydrocarbon entering stripper 14. When provided, additional concentrator 86 will typically raise the concentration of solids in the conveying stream or vehicle to a range of from 1 to 50 wt %. FIG. 1 shows a hydroclone as the concentrator 86 that receives the slurry from line 85 and produces a further clarified oil stream 87 and an underflow of highly concentrated solids. The highly concentrated flow of solids will ordinarily flow directly back into stripper 14 via lines 88 and 66. The clarified stream 87 depending upon its concentration of particulate material may be recovered directly as a product stream or recycled back to the main column for further separation into additional fractions or further removal of particulate material. The clarified stream 87 may also be returned as recycle to the riser via line 18.

Figure 2:
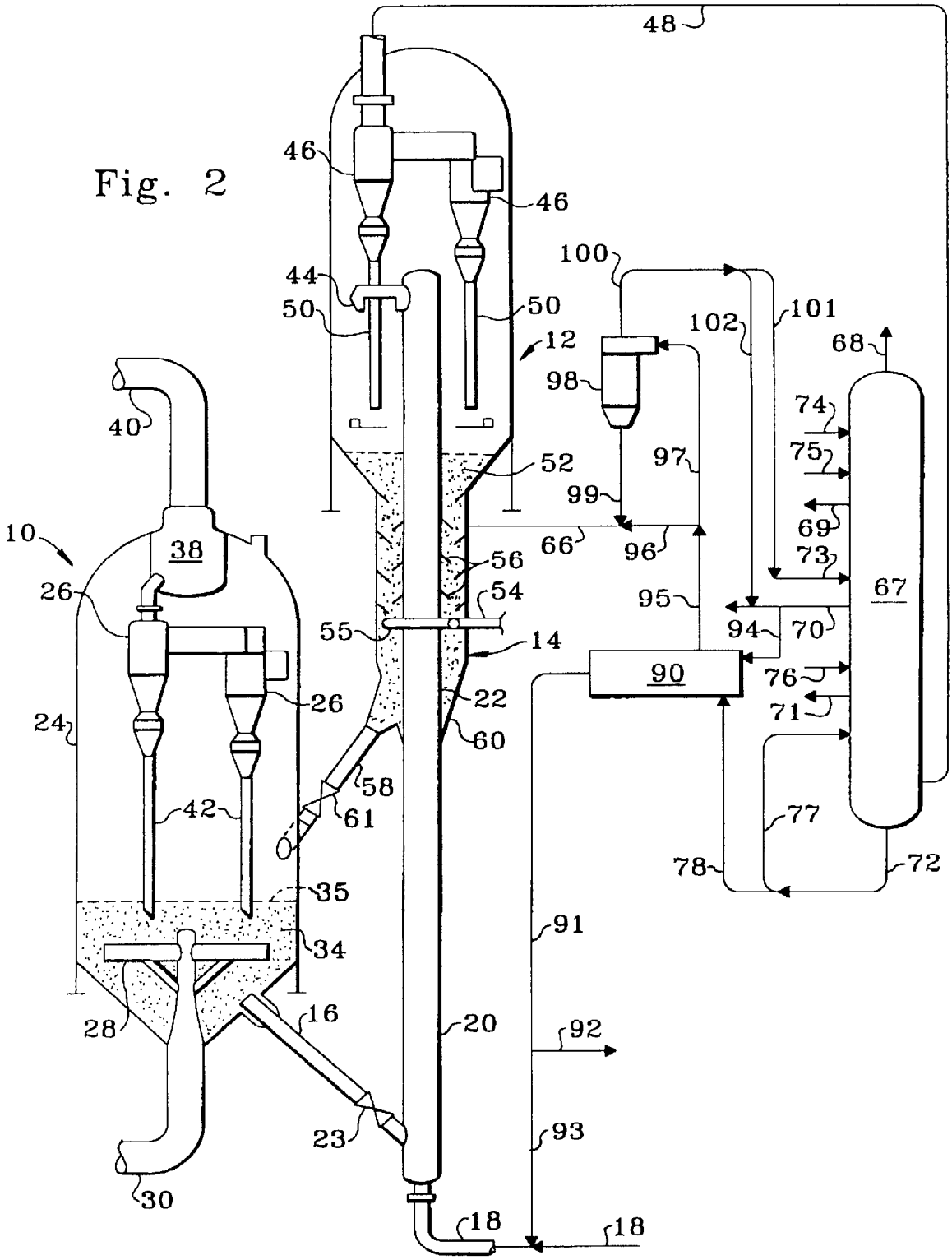
FIG. 2 is a modified schematic flow diagram of a primary separator, an FCC reaction zone, and an FCC regeneration zone of FIG. 1.

An alternate arrangement for concentrating the solids recovered from the main column 67 via the bottoms stream in line 72 is shown in FIG. 2. FIG. 2 uses like reference numerals from FIG. 1 to describe the same elements shown in FIG. 2. In the arrangement shown in FIG. 2, the remainder of the bottoms stream in line 72 that does not reenter column 67 as recycle via line 77 passes via line 78' to a particulate filter system 90. Filter system 90 removes a majority of the fine particles from the bottom stream in line 78' and produces a clarified bottom stream 91 having a fines concentration that is typically in a range of from 0.05 to 0.005 wt %. A portion of the fines bottom stream may be withdrawn by line 92 for further process or recovery as product while any remainder will typically return to the riser for further cracking via a line 93. Filtration system 90 uses a portion of the light cycle oil from line 70, transferred thereto via a line 94, to purge the fine particulates from the filter element. The portion of the light cycle oil stream containing the fine particles passes out of filtration system 90 via line 95 and can again be passed directly to the reactor stripper 14 via a line 96. Additional concentration of the light cycle oil may be accomplished by passing it via a line 97 to hydroclone 98 for additional removal of particulate material from the light cycle oil and for minimization of the amount of light cycle oil passing as underflow into stripper 14 via a lines 99 and 66. The light cycle oil recovered as overflow from the hydroclone 98 via line 100 may pass back to the main column via line 101 for further processing and possible recovery of fines in the main column or, given a low enough fines concentration, may be combined directly via line 102 with the net light cycle oil stream recovered from the main column 67 via line 70.

The main column bottoms and heavy cycle oil are not preferred as vehicles for return of the recovered fine material to the stripper zone. The main column bottoms as well as the heavy cycle oil will have relatively low volatility and will tend to remain adsorbed on the catalyst particles as it passes through the stripper. Any hydrocarbons recycled directly to the stripper that remain on the catalyst as it passes into the regenerator will reduce product yield and increase delta coke.

Light cycle oil with its lower boiling points and higher volatility is a more suitable vehicle for returning the recovered fine particles to the relatively dense bed of the reactor stripping zone. Light cycle oil that contacts the catalyst will again be stripped in large measure before withdrawal of the catalyst from the bottom of the stripping zone. Therefore, light cycle oil will minimize any increase in delta coke or loss of products by its use as a vehicle for return of the fine particle directly to the stripping zone.

It is preferred that the particles be added to the stripping zone at a location near the top of the dense bed. Adding the particles near the top increases the amount of stripping that is available to remove the additional hydrocarbon that transport the fine particles without adsorbtion of the hydrocarbon on to the catalyst. However, there should be some length of bed above the injection point in order to hold the fines in the bed. Lighter materials for carrying the fine material back into the stripping zone, while more easily stripped, are not preferred due to the additional flashing and possible reentrainment of fine particles with the rising product vapors that return to the main fractionator.

EXAMPLE

The following example shows the use of the particle recycle arrangement of this invention to reduce the concentration of the fine catalyst particles—having a size of less than 40 microns—in circulation through the main column bottoms. This example is based on engineering calculations and operating data obtained from similar systems and operating FCC units. The table sets forth two cases. The conditions for the two cases are identical except that the first case recycles the recovered fines from the slurry system directly to a reactor riser and the second case recycles the recovered fines from the slurry system to an FCC stripping zone. The resulting comparison shows a reduction in the concentration of the catalyst fines entering the main columns from 320 lbs/hr for the first case to 80 lbs/hr for the second case.

| | Case: | |
|---|---|---|
| | Case 1 | Case 2 |
| Nominal Unit Capacity, BPSD (barrels/stream day) | 50,000 | 50,000 |
| Total Overhead to Main Fractionator, Lbs/hr | 722,218 | 722,218 |
| Heavy Oil Product, BPSD | 5208 | 5208 |
| Light Cycle Oil Product, BPSD | 9896 | 9896 |
| Naphtha Sidedraw Product, BPSD | 3499 | 5588 |
| Ovhd Receiver Vapors to Compressor, MMSCFD | 57.64 | 58.52 |

In both cases an FCC unit is operated to process 50,000 barrels/stream day of a vacuum gas oil feed. The feed is contacted with a catalyst and lift gas mixture in the bottom of a reactor riser and enters a reactor vessel that operates at a pressure of about 25 psig. Lift gas consists of approximately 2 wt. % steam and 2 wt. % light hydrocarbon based on feed. An additional 2 wt. % of steam is injected to atomize the heavy oil feed. Product hydrocarbons are disengaged from the catalyst in the disengaging chamber and a riser cyclone. The catalyst travels downwardly through a first stage of a stripping section that operates at approximately the same temperature as the upper end of the reactor riser. Catalyst passing through the stripper is contacted with gas that enters the bottom of the stripper. The stripping gas volume provides a superficial gas velocity through the stripper of 0.5 ft/sec and first contacts the spent catalyst in the lower section of the stripper. The stripping gas removes absorbed hydrocarbons from the surface of the catalyst and the stripping gas becomes mixed with light paraffins and hydrogen. The stripping gas mixture consisting of gases and vapors passes upwardly from the lower section of the stripper and is collected in an upper section of a reactor vessel. The gaseous mixture in the upper portion of the reactor vessel passes into the same cyclone separators that receive the riser products. All of the products, in the form of highly superheated vapors from the reaction zone, are transferred directly to a primary fractionation zone where they are fractionated into the various fractions of various boiling point ranges.

At the bottom section of the column, both cases withdraw a net heavy oil product. The operating temperature in this section ranges from 650 to 725 degrees F, and heat in excess of that required for fractionation of the lighter components is recovered in a bottoms circulating stream. Both examples have a heavy cycle oil (HCO) pumparound incorporated at a section above the bottoms section. The section above the HCO pumparound is the light cycle oil (LCO) product draw and circulation section. Net LCO product with a 450–700 deg. F boiling range is netted from this section. The naphtha product and circulation section is located above the LCO section. The net naphtha product sidedraw with a typical boiling range of 250–450 deg. F, is processed in a steam stripper (not shown) in order to stabilize it and meet vapor pressure requirement. In these examples, the bulk of the circulating streams are heat exchanged for heat recovery and returned to the main fractionator.

In both cases the bottoms stream from the main column enters a slurry settler that effects an approximate 50% removal of fines from the net portion of the main column products and rejects about 5200 BPSD of a bottoms stream containing 0.01 wt % solids. In case 1, 2000 BPSD of main column bottoms containing 312 lbs/hr of fine catalyst particles were returned to the FCC riser. In Case 2, 2000 BPSD of main column bottoms containing about 72 lbs/hr of fine particles were returned to the the FCC stripping section. In case 1 approximately 76,200 lbs/hr of product leaving the cyclones of the reactor vessel carried over about 320 lbs/hr of solids. In case 2 approximately 76,200 lbs/hr of product leaving the cyclones carried over only about 80 lbs/hr of solids.

Case 2 of the example demonstrates the substantial reduction in ciruculating fines that was obtained by the method and apparatus of this invention.

What is claimed is:

1. A process for the production and separation of a fluidized catalytic cracking (FCC) product stream wherein the product stream contains fine catalyst particle, the process comprising:

a) passing an FCC feedstock and regenerated catalyst particles to a reaction zone to convert said feedstock;

b) separating catalyst particles from gaseous hydrocarbons and recovering an FCC product stream containing fine catalyst particles and passing separated particles to a relatively dense bed;

c) passing the FCC product stream to a fractionation zone and to separating the FCC product stream in the fractionation zone into at least a relatively light hydrocarbon stream and a relatively heavy hydrocarbon stream;

d) recovering a particle recycle stream containing fine catalyst particles and at least a portion of the relatively heavy hydrocarbon stream;

e) concentrating particles in the particle recycle stream to provide a concentrated particle stream having a higher concentration of particles than the particle recycle stream;

f) injecting the concentrated particle stream directly into the relatively dense bed at an injection point;

g) withdrawing a coked catalyst stream comprising at least a portion of the fine particles from the relatively dense bed at a location below the injection point and passing the coked catalyst stream to a regeneration zone; and, h) combusting coke from catalyst particles in the regeneration zone to generate flue gas that passes out of the regeneration zone carrying entrained fine catalyst particles therewith to supply regenerated catalyst to the reaction zone.

2. The process of claim 1 wherein said relatively dense bed comprises a stripping zone.

3. The process of claim 1 wherein the relatively heavy hydrocarbon stream comprises a hydrocarbon stream in the boiling range of a light cycle oil or a heavier hydrocarbon stream having a higher boiling point range.

4. The process of claim 1 wherein the fractionation zone comprises an FCC main column that separates the product stream into at least a light cycle oil stream and a bottom stream having a boiling point of at least 650° F., a filter recovers fine catalyst particles from the bottom stream and the light cycle oil stream or a lower boiling fraction returns the fine particles from the filter to the relatively dense bed.

5. The process of claim 1 wherein the recycle stream containing fine particles comprises a portion of an FCC main column bottoms stream.

6. The process of claim 1 wherein the concentrated particle stream passes to a hydroclone to increase the concentration of fine catalyst particles and to produce a more concentrated stream that injects the fine particles from the concentrated particle stream into the relatively dense bed.

7. The process of claim 6 wherein the concentrated stream is the underflow from the hydroclone that passes directly to an FCC stripper and the overflow from the hydroclone comprises a light cycle of heavy naphtha boiling range stream.

8. The process of claim 1 wherein the fine catalyst particles comprise particles having a size of less than 40 $\mu$m.

9. The process of claim 8 wherein the concentration of fine catalyst particles having a size of less 20 $\mu$m in the FCC product stream is in a range of 1.5 to 0.05 wt % of the FCC product stream.

10. The process of claim 1 wherein the separated particles in the relatively dense bed comprise spent catalyst and the relatively dense bed has a temperature that is less than the temperature of the regenerated catalyst particles that enter the reaction zone.

* * * * *